US006065847A

United States Patent [19]

Palmer et al.

[11] Patent Number: 6,065,847

[45] Date of Patent: May 23, 2000

[54] CHEMILUMINESCENT PACKAGING

[75] Inventors: William R. Palmer; Stephen L. Palmer, both of Cameron Park, Calif.

[73] Assignee: Omniglow Corporation, West Springfield, Mass.

[21] Appl. No.: 09/135,472

[22] Filed: Aug. 17, 1998

[51] Int. Cl.[7] ..... F21K 2/00

[52] U.S. Cl. ..... 362/34; 362/84; 206/219; 206/221

[58] Field of Search ..... 362/34, 84; 206/219, 206/221

[56] References Cited

U.S. PATENT DOCUMENTS

| | | | |
|---|---|---|---|
| 3,576,987 | 5/1971 | Voight et al. | 240/2.25 |
| 3,819,925 | 6/1974 | Ritcher et al. | 240/2.25 |
| 5,508,893 | 4/1996 | Nowak et al. | 362/34 |

*Primary Examiner*—Sandra O'Shea
*Assistant Examiner*—John A. Ward
*Attorney, Agent, or Firm*—McHale & Slavin

[57] ABSTRACT

The instant invention is directed to an improved package for securing a chemiluminescent lighting device in a storage condition. In particular, the packaging consists of a heat-shrinkable opaque jacket which protects the chemiluminescent chemicals from degradation by light while simultaneously providing rigidity to the device by use of a PVC film or the like thermo-wrap-plastic capable of blocking light and adhering to the outer shape of the chemiluminescent lighting device. Due to the extremely tight fit of the material around the lighting device coupled with the presence of a score line included in the wrap material, a fracture zone is created such that any impact or flexing sufficient to cause admixture of the chemiluminescent components will, in turn, cause the wrapping material to break at the score line and be instantaneously shed. This feature allows the user to readily activate and unwrap the material in one quick and easy motion while acting as an indicator that the lighting device has been activated.

17 Claims, 1 Drawing Sheet

CHEMILUMINESCENT PACKAGING

FIELD OF THE INVENTION

This invention relates to the field of chemiluminescent lighting and, in particular, to an improved chemiluminescent device packaging that provides storage and allows for the simultaneous removal of the packaging upon device activation.

BACKGROUND OF THE INVENTION

Chemiluminescent lighting devices are capable of producing light upon the chemical reaction of an oxalate and an activator. The production of light from a chemiluminescent device is conventionally based upon the reaction of a catalyzed hydrogen peroxide mixture (activator) with an oxalate. A great variety of chemical reagents for producing light by chemiluminescent reaction are known. A typical commercially available chemiluminescent device that produces a yellow color can be created from the following constituents: Dibutyl Phthalate 66.45%; Dimethyl Phthalate 20–35%; CPPO bis(2,4,5-trichloro-6-carbopentoxyphenyl) oxalate 8.33%; T-butyl alcohol 3.3%; 90% aq. Hydrogen Peroxide 1.32%; CBPEA 1-chloro-9,10-bis(phenylethynyl) anthracene 0.23%; and Sodium Salicylate 0.0025%.

The activator reagent is typically contained within a breakable vial(s) which, when broken, admixes with the oxalate reagent to produce the chemiluminescent light. The activator and oxalate placement may be reversed. Since the object of this type of device is to produce usable light output, the containment vessel is made of a clear or translucent material such as polyethylene or polypropylene which permits the light produced by the chemiluminescent device to pass through the vessel walls.

Chemiluminescent lighting devices are commonly used as a supplement and/or replacement for conventional illumination devices such as flashlights and flares. Chemiluminescent devices are non-incandescent products and are most valuable for emergency lighting applications such as when normal electrical power service is interrupted. Power interruptions often accompany storms, floods, hurricanes, fires, earthquakes and the like natural disasters. Additionally, because chemiluminescent devices do not rely on electricity for operation, they are readily and reliably used in wet environments, even under water, where electrically powered devices could short out and fail.

Also unique to chemiluminescent devices are their ability to produce light without generating heat. Since chemiluminescent devices are not electrically operated or sources of ignition, they are ideally suited to emergency situations such as the aforementioned disasters. For instance, in situations where flammable vapors such as gasoline or natural gas may be present, conventional illumination such as candles, lanterns or even flashlights pose extreme danger as potential sources of ignition.

One of the benefits of chemiluminescent lighting devices is the ability to provide light upon demand. However, the chemicals that cause the chemiluminescent reaction must be properly protected to prevent premature chemical degradation. Chemiluminescent chemicals are subject to degradation but, if shielded from light, optimum illumination can be expected if properly stored. For this reason, such devices may be packaged in aluminum foil. To activate a conventional chemiluminescent device, an individual must tear open the foil package, remove the packaging from the device, and then activate the device to cause the chemical reaction and subsequent illumination.

If the chemiluminescent device was unintentionally activated prior to removal from the foil packaging, it may have expended all useful illumination. Premature activation may occur if the product was mishandled to cause ampule breakage without damaging the foil packaging. The foil packaging techniques allows flexing of the lighting device which can result in the cracking of the ampule without damaging the packaging. For example, chemiluminescent lighting devices are commonly stored in emergency kits as a substitute for flares wherein mishandling is possible such that an object may cause the device to flex, thereby starting the activation with no apparent damage to the packaging. The result is that the chemiluminescent chemical will have expended its useful life and, should the device be needed, it will no longer function.

Product packaging is typically how chemiluminescent chemicals are protected from light to promote product shelf life. For example, product packaging for chemiluminescent light sticks has been produced from optically opaque, metallic foil and plastic film laminates to shield the chemiluminescent reagents from photo degradation whether from natural or artificial light. Another method to protect chemiluminescent products from photo degradation is to package the chemiluminescent devices in bulk, either in metal buckets or cardboard tubes. In either event, external product packaging, whether it be a foil wrapper or cardboard tubes, once opened or damaged may allow light to contact the chemical reagents leading to the photo degradation.

Thus, one problem with the prior art packaging is the concealment of the chemiluminescent lighting device within a package that masks premature activation of the chemiluminescent product. Further, should the device be damaged, it cannot be viewed without destroying the packaging jacket.

Another problem exists in the need for using two hands for removal of the foil packaging. For instance, should a chemiluminescent lighting device be used as an emergency lighting device in a darkened home, an individual may find it difficult to open the packaging in the dark. This problem is enhanced if the individual is a child, elderly or otherwise physically handicapped wherein the ability to tear open the foil wrapper is made even more difficult due to the darkened conditions. While various manufacturer's serrate the edges, opening the package requires two hands.

In an emergency situation, should an individual's hand be wet or in a weakened condition, this extra step may render the device unusable. In emergency situations it is impractical to remove a chemiluminescent device from foil wrappers prior to activation. Also, tools may not be readily available to open the buckets or cardboard tubes of bulk packaged products. Additionally, metal films are subject to corrosion when in the prolonged presence of moisture which limits their effective application in this instance. Similarly, if such a device is to be employed in a life raft, wet hands or hands covered with gloves would make opening of the foil packaging most difficult when immediate activation is necessary.

Thus, what is lacking in the art is a chemiluminescent lighting device package capable of indicating damage as well as providing ease of package removal. Activation of the chemiluminescent light device results in partial or complete package removal if packaged according to the teachings of this disclosure.

SUMMARY OF THE INVENTION

The instant invention is directed to an improved package for securing a chemiluminescent lighting device in a storage condition. In particular, the packaging consists of a shrink-wrapped opaque, or nearly opaque, jacket which protects the chemiluminescent chemicals from light degradation while also providing some rigidity. A PVC film or the like thermo-wrap-plastic is capable of blocking light and adhering to the outer shape of the chemiluminescent lighting device. The tightly adherent wrapper also allows the devices to be bundled in a high density configuration. This is especially useful when space is at a premium, for example during shipping. There is a distinct advantage to being able to package a large quantity of the shrink-wrapped lighting devices in a comparatively small area, thereby lowering the cost of shipping and the possibility of damage.

In the preferred embodiment, the jacket is formed from a shape conforming material that is placed over a chemiluminescent lighting device. The material conforms to the outer shape of the lighting device upon the application of hot air. The thermo-wrap-plastic film shrinks providing a tight jacket around the device. The ends of the jacket can be deformed during the heating process, so as to inhibit light transfer through the ends, or sealed by any other means. The jacket is further scored to a depth of approximately half of the thickness of the jacket material.

To initiate activation, the chemiluminescent lighting product is activated by either bending or striking the housing against a hard object. The force required to cause activation of the chemiluminescent product results in sufficient deflection of the housing to cause breakage of the ampule. The jacket will split open along the seam line when the housing is bent.

In this manner, the activation of the chemiluminescent lighting product results in the simultaneous opening of the packaging. The remaining packaging can then be removed by peeling the remaining portion of the jacket from the housing. This can be accomplished singlehandedly even with a gloved hand. The ability to remove the packaging in emergency situations is critical. In adverse conditions, where the multi-step deployment of prior art devices is cumbersome or time consuming, single hand removal may be the only manner in which packaging can be removed.

Breakage of the packaging jacket can be further facilitated by the use of a chemiluminescent lighting device holder. In this embodiment, the chemiluminescent light device is initially placed across the bridge of a holder. An individual may grasp the chemiluminescent lighting device and flex it sufficiently to remove it from the holder. This results in activation of the device, and partial or complete removal of the jacket during the removal from holder.

An objective of the instant invention is to provide a chemiluminescent device packaging capable of removal simultaneously upon the activation of the device.

Still another objective of the instant invention is to disclose a packaging process that is inexpensive to apply and provides an indication of the condition of the chemiluminescent device from previous handling.

Yet still another objective of the instant invention is to teach the use of a shrink-wrap type package that allows for single-hand removal, rapid deployment and activation.

Still another objective is to disclose a package that allows for compact storage of chemiluminescent devices.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 4:
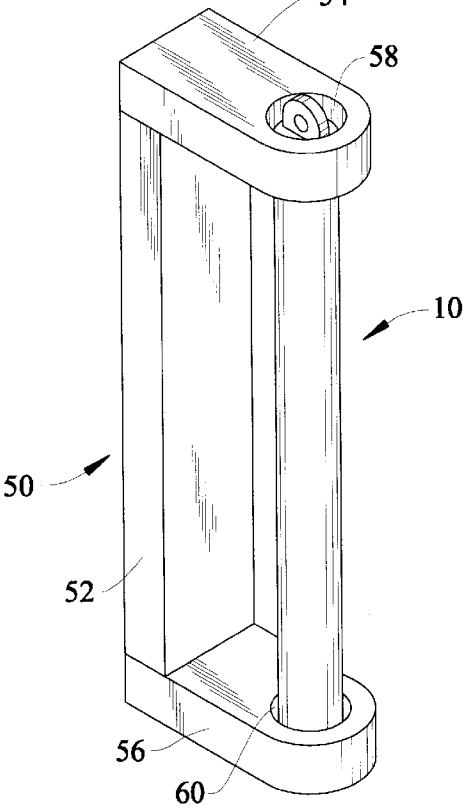
FIG. 4, is a perspective view of a lighting device holder having a lighting device inserted therein.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 1B:
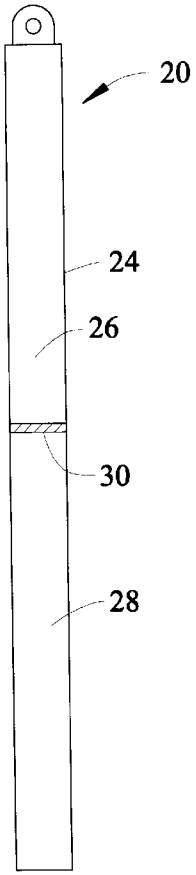
FIG. 1B, is a cross-sectional view of an alternative prior art chemiluminescent lighting device.
Figure 1A:
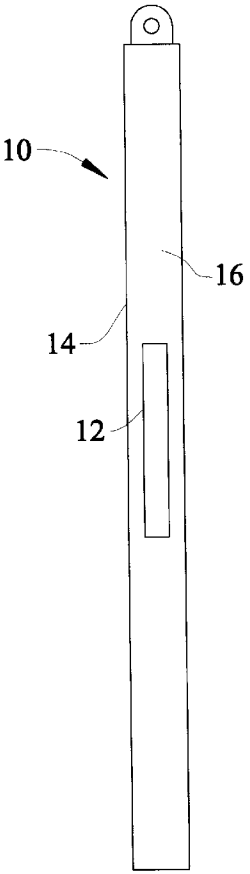
FIG. 1A, is a cross-sectional view of a prior art chemiluminescent lighting device.

Now referring to FIG. 1A, a chemiluminescent lighting device 10 is illustrated as marketed under the Applicant's trademark "CYALUME". An ampule 12, containing the oxalate portion of the chemiluminescent mix, is shown enclosed within a housing or outer container 14 which additionally accommodates the activator portion 16 of the chemiluminescent mixture.

It should be noted that numerous types of housing exist. For example referring to FIG. 1B, an alternative lighting device 20 is shown, wherein the outer container 24 defines first and second hollow chambers, the first chamber 26 containing either the chemiluminescent oxalate component or chemiluminescent activator, and the second hollow chamber 28 filled with the second chemiluminescent oxalate component or chemiluminescent activator. The chambers are separated by a frangible or movable partition 30, such that the device is available for activation upon fracturing or moving of the partition thereby allowing admixture of the oxalate and activator.

For convenience, the remaining embodiments will be described with reference to the embodiment of FIG. 1A, although it is fully within the scope of this invention to incorporate all styles of chemiluminescent housings.

Figure 2:
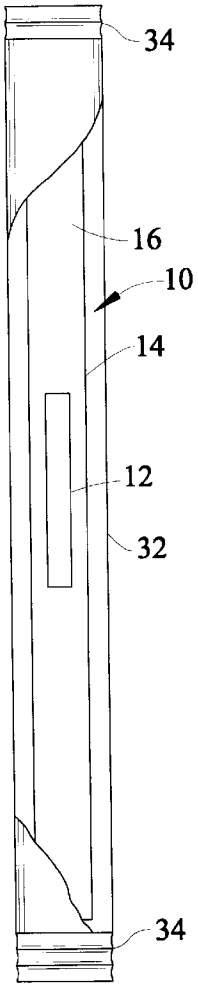
FIG. 2, is a cut-a-way view of a standard chemiluminescent lighting device having an aluminum jacket.

Referring now to FIG. 2, the chemiluminescent lighting device 10 is illustrated with an aluminum jacket outer wrapper 32, and shown in a cut-away view. An ampule 12 containing the oxalate portion of the Chemiluminescent mixture is placed within the outer container 14 having the activator portion 16 retained therein. It is noted, that the outer wrapper is loose fitting. This is necessary for ease of ingress and egress of the chemiluminescent device. Note that the ends 34, of the aluminum jacket are crimped and sealed so as to prevent light from entering the container.

Figure 3:
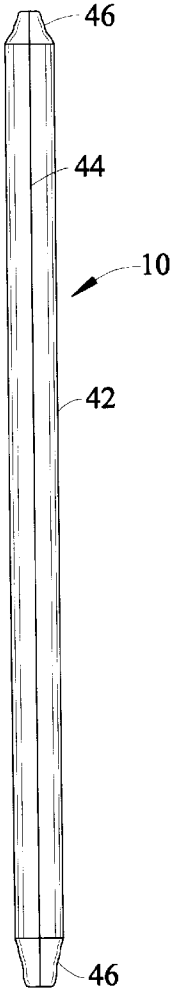
FIG. 3, is a perspective view of a chemiluminescent lighting device having a thermo-wrap-plastic jacket.

Now referring to FIG. 3, the chemiluminescent device 10, wrapped in a jacket 42 formed from a heat-shrinkable conforming film is shown. The heat-shrinkable jacket used to encase the chemiluminescent device can be made from a variety of well known heat-shrink materials. Among these are PVC (polyvinyl chloride), polyolefin, PET (polyethylene terephthalate), PET-G (Glycol PET), PTFE (polytetrafluoroethylene), PVDF (polyvinylidene fluoride). It is contemplated that some or all of these materials may additionally incorporate an effective amount of a flame retardant additive if desired. The conforming film jacket 42 contains a scoring mark, perforations, or other tear propagating or initiating means 44 which penetrates the material to a depth of approximately half of the thickness of the jacket material. The wall thickness of the heat-shrinkable jacket material may range from about 0.0021"–0.012" thickness, with the provison that the materials have sufficient opacity so as to prevent light from damaging the chemiluminescent chemicals within the housing. The chemiluminescent device is inserted into the film and subsequently exposed to hot air, steam, or radiant heat causing the heat-shrinkable film to contract, thereby forming a compact sheath that forms a tightly fitting package which fully surrounds and closely corresponds to the shape of the underlying chemiluminescent device. Due to the extremely tight fit of the material around the lighting device, coupled with the presence of the scoring mark, perforations, or other tear propagating or initiating means included in the wrap material, a fracture zone is created such that any impact or flexing sufficient to fracture the internal ampule and cause admixture of the chemiluminescent components will cause the wrapping material to break at the score line and be instantaneously shed. This feature has a two-fold purpose. First, it allows the user to readily activate and unwrap the material in one quick and easy motion; secondly, it acts as an indicator that the lighting device has previously undergone sufficient flexure to warrant determining if it is, in fact, still usable.

Hot air is further directed toward both ends of the heat-shrinkable film to tightly conform them about the ends 46 of the chemiluminescent device so as to prevent light from entering and causing degradation of the chemicals.

The heat-shrinkable material offers the further advantage of being readily printable. Descriptive indicia may be conveniently applied to the material by such known printing techniques as photogravure, flexographic, pad printing, silk screening or other known means.

Referring to FIG. 4, a lighting device holder 50 is shown. The holder defines a bridge 52 approximately equivalent in length to the lighting device, and two perpendicular legs 54 and 56. The holder is utilized to retain the chemiluminescent lighting device 10 which is supportively and releasably engaged in recesses 58 and 60. This holder may be mounted conveniently on an article of clothing, a wall, a work bench or anywhere that it would be desirable to have a rapidly deployable lighting device. When a situation arises where a lighting device is required, the user will typically grasp the lighting device and forcefully pull it from the holder, thereby causing sufficient flexure in removing the device to simultaneously cause admixture of the chemiluminescent components and dislodge the outer wrapper.

Those skilled in the art will appreciate that numerous variations of the specific embodiments set forth above may be practiced without departing from the spirit of the invention, as claimed below.

What is claimed is:

1. A chemiluminescent lighting device comprising, in combination:

a shaped housing having a hollow chamber containing segregated first and second chemiluminescent components, said housing being constructed and arranged so as to allow chemiluminescent light to transmit through said housing upon admixing of said components; and a protective outer jacket constructed and arranged so as to completely surround said housing and conform to the shape thereof;

wherein application of a force sufficient to cause admixture of the chemiluminescent components will initiate a chemiluminescent reaction and simultaneously cause said outer jacket to rupture along a fracture zone thereby providing instantaneous shedding of said outer jacket.

2. The chemiluminescent lighting device according to claim 1, wherein the outer jacket is a heat-shrinkable polymer.

3. The chemiluminescent lighting device according to claim 2, wherein said heat-shrinkable polymer is selected from the group consisting of polyvinyl chloride, polyolefin, polyethylene terephthalate, glycol polyethylene terephthalate, polytetrafluoroethylene, and polyvinylidene fluoride.

4. The chemiluminescent lighting device according to claim 2, wherein said heat-shrinkable polymer further includes an effective amount of a flame retardant additive.

5. The chemiluminescent lighting device according to claim 2, wherein said heat-shrinkable polymer outer jacket has a wall thickness in the range of 0.002"–0.012".

6. The chemiluminescent lighting device according to claim 1, wherein said outer jacket is partially opaque.

7. The chemiluminescent lighting device according to claim 1, wherein said outer jacket is opaque.

8. The chemiluminescent lighting device according to claim 1, wherein said fracture zone is a scoring mark applied prior to shrinking onto the chemiluminescent lighting device.

9. The chemiluminescent lighting device according to claim 1, wherein said fracture zone is further defined as a scoring mark, perforation, or the like tear propagating or initiating means.

10. The chemiluminescent lighting device according to claim 1, wherein said fracture zone is a score line which extends axially along said jacket.

11. The chemiluminescent lighting device according to claim 1, wherein said fracture zone is a score line which extends axially along said jacket at a depth equal to about one half the wall thickness of said jacket.

12. The chemiluminescent lighting device according to claim 1, wherein said outer jacket provides rigidity to said housing.

13. The chemiluminescent lighting device according to claim 1, wherein said hollow chamber contains one of said chemiluminescent oxalate component and chemiluminescent activator component, and further includes an ampule containing the other of said chemiluminescent oxalate component and chemiluminescent activator component;

whereby said device is adapted for initiation of the chemiluminescent reaction upon breakage of said ampule so as to allow admixture of said oxalate and activator components.

14. The chemiluminescent lighting device according to claim 1, wherein said hollow chamber is further defined as a first hollow chamber filled with one of said chemiluminescent oxalate component and chemiluminescent activator component, and a second hollow chamber, filled with the other of said chemiluminescent oxalate component and chemiluminescent activator component;

said first and second hollow chambers separated by a frangible or moveable partition;

whereby said device is adapted for initiation of the chemiluminescent reaction upon fracture or movement of said partition so as to allow admixture of said oxalate and activator components.

15. The chemiluminescent lighting device according to claim 1, further including descriptive indicia applied to said outer jacket.

16. The chemiluminescent lighting device according to claim 1, further including a lighting device holder for supportive engagement of said housing;

said holder having means to supportively and removably engage said housing;

whereby removal of said device from said holder results in activation of said device and simultaneous removal of said outer jacket.

17. A method for packaging chemiluminescent lighting devices for rapid deployment comprising:

inserting a chemiluminescent lighting device within a heat-shrinkable polymer jacket containing a fracture zone;

applying a source of heat to said jacket thereby creating a tightly conforming outer jacket; and bundling said devices in a high density configuration;

whereby activation of said device and removal of said jacket are simultaneously accomplished in one step thereby enabling rapid deployment.

* * * * *